US009803431B1

(12) United States Patent
Allen et al.

(10) Patent No.: US 9,803,431 B1
(45) Date of Patent: Oct. 31, 2017

(54) COPPER COVERED VORTEX-INDUCED VIBRATION SUPPRESSION DEVICES

(71) Applicant: VIV Solutions LLC, Richmond, TX (US)

(72) Inventors: Donald Wayne Allen, Richmond, TX (US); Julie Ann Dehne, Cypress, TX (US); John Wayne Gape, Cypress, TX (US)

(73) Assignee: VIV Solutions LLC, Richmond, TX (US)

( * ) Notice: Subject to any disclaimer, the term of this patent is extended or adjusted under 35 U.S.C. 154(b) by 1 day.

(21) Appl. No.: 14/918,403

(22) Filed: Oct. 20, 2015

Related U.S. Application Data

(60) Provisional application No. 62/066,889, filed on Oct. 21, 2014.

(51) Int. Cl.
*E21B 17/10* (2006.01)
*E21B 17/01* (2006.01)

(52) U.S. Cl.
CPC ..... *E21B 17/10* (2013.01); *E21B 17/01* (2013.01)

(58) Field of Classification Search
CPC . B63B 2021/504; E21B 17/01; E21B 17/012; E21B 47/0001
See application file for complete search history.

(56) References Cited

U.S. PATENT DOCUMENTS

| | | | | |
|---|---|---|---|---|
| 3,395,530 A * | 8/1968 | Campbell | B05D 7/20 | 106/18.35 |
| 4,728,224 A * | 3/1988 | Salama | B63B 21/502 | 166/367 |
| 6,067,922 A * | 5/2000 | Denison | B63B 21/663 | 114/243 |
| 6,695,540 B1 * | 2/2004 | Taquino | E21B 17/01 | 114/243 |
| 2002/0112858 A1 * | 8/2002 | McDaniel | E21B 17/012 | 166/350 |
| 2009/0185867 A1 * | 7/2009 | Masters | F16L 1/123 | 405/216 |

* cited by examiner

*Primary Examiner* — James G Sayre
(74) *Attorney, Agent, or Firm* — Blakely Sokoloff Taylor & Zafman LLP

(57) ABSTRACT

A vortex-induced vibration (VIV) suppression apparatus including a body having a wall dimensioned to at least partly envelope a tubular member in an interior area of the body; at least one extension member extending from the body; and an anti-fouling member mechanically coupled to at least one of the body or the extension member. A method of manufacturing a vortex-induced vibration (VIV) suppression device including providing a VIV suppression device having a body dimensioned to at least partly envelope a tubular member in an interior area of the body and at least one extension member extending from the body. The method further including attaching an anti-fouling sheet to the VIV suppression device.

19 Claims, 7 Drawing Sheets

COPPER COVERED VORTEX-INDUCED VIBRATION SUPPRESSION DEVICES

CROSS-REFERENCE TO RELATED APPLICATION

The application is a non-provisional application of U.S. Provisional Patent Application No. 62/066,889, filed Oct. 21, 2014 and incorporated herein by reference.

FIELD

A vortex-induced vibration (VIV) suppression device having an anti-fouling member, more specifically a VIV suppression device having an anti-fouling layer. Other embodiments are also described herein.

BACKGROUND

A difficult obstacle associated with the exploration and production of oil and gas is management of significant ocean currents. These currents can produce vortex-induced vibration (VIV) and/or large deflections of tubulars associated with drilling and production. VIV can cause substantial fatigue damage to the tubular or cause suspension of drilling due to increased deflections. Both helical strakes and fairings can provide sufficient VIV suppression.

Helical strakes and fairings are both popular VIV suppression devices. However, the effectiveness of helical strakes and fairings can be substantially degraded due to the presence of marine growth or other rough elements on its external surface. Presently, the technologies that are applied to prevent marine growth fouling (also known as "anti-fouling" methods) consist of paints or coatings that are applied by spraying the material onto the (helical strake or fairing) surface.

Present anti-fouling methods are expensive and often have lifetimes that are insufficient for oil and gas platform tubulars that must resist fouling for periods of 30-50 years or more. In addition, these paints and coatings require multiple applications so that the manufacturing can be increased substantially. Finally, some present methods impose substantial surface roughness onto the strake from particles in the coating, which partially defeats the purpose of using an anti-fouling coating.

SUMMARY

The present invention consists of anti-fouling methods that incorporate an anti-fouling sheet, such as a copper sheet or film, that is bonded or attached to the surface of the VIV suppression device. The method disclosed herein provides an anti-fouling sheet that is relatively inexpensive to apply and can be effective for a number of years (e.g. 50 years or more). In addition, the anti-fouling sheet may be quick to apply and suitable for keeping the surface of the VIV suppression device relatively smooth.

In one embodiment, a vortex-induced vibration (VIV) suppression device is provided. The device may include a body dimensioned to at least partly envelope a tubular member in an interior area of the body. The device may further include at least one extension member extending from the body and an anti-fouling member mechanically coupled to at least one of the body or the extension member. The extension member may be, for example, a fin in the case of a helical strake VIV suppression device or a fin in the case of a fairing. The anti-fouling member may be positioned over an outer surface of a wall of the body and/or the extension member. The anti-fouling member may include a sheet of anti-fouling material. For example, the anti-fouling material may be copper, a copper-nickel alloy, a copper-zinc alloy or a copper-tin alloy. In some embodiments, the sheet of anti-fouling material is mechanically attached to the at least one of the body or the extension member by a fastener. Still further, the sheet of anti-fouling material may be attached to the body by inserting the sheet within a channel along an edge of the body. The body may include at least two sections that fit together to form the body. The extension member may be a fin that includes a slot dimensioned to receive a band for securing the body to a tubular member.

In another embodiment, the invention relates to a helical strake assembly including a helical strake having a body section and a fin helically arranged around the body and an anti-fouling sheet coupled to the helical strake. The anti-fouling sheet may be positioned along an exterior surface of the helical strake. The anti-fouling sheet may be coupled directly to the body section and the fin. In some cases, the anti-fouling sheet may be dimensioned to conform to an exterior surface of the helical strake. In one embodiment, the anti-fouling sheet may be coupled to the helical strake by a "C" shaped clamp positioned along an edge of the body section.

In another embodiment, the invention relates to a fairing assembly for suppressing a vortex-induced vibration (VIV) of a tubular, the fairing assembly comprising a fairing having a wall forming a body portion, a tail portion and an end portion, and an anti-fouling sheet coupled to an interior surface and an exterior surface of the wall of the fairing.

A process of manufacturing a vortex-induced vibration (VIV) suppression device is further provided. The process may include providing a VIV suppression device having a body dimensioned to at least partly envelope a tubular member in an interior area of the body and at least one extension member extending from the body. The process may further include attaching an anti-fouling member to the VIV suppression device. The anti-fouling member may be attached to the device by, for example, fastening the anti-fouling member to the exterior surface of the wall of the body and/or positioning a band around the anti-fouling member and the body of the VIV suppression device. In other embodiments, the anti-fouling member may be positioned within a channel formed along an edge of the wall of the body. In still further embodiments, a thermal or chemical process may be used to attach the anti-fouling member to the exterior surface of the wall of the body. In some embodiments, the anti-fouling sheet is preformed to have a shape of the VIV suppression device prior to attaching the anti-fouling sheet to the VIV suppression device.

The above summary does not include an exhaustive list of all aspects of the present invention. It is contemplated that the invention includes all apparatuses that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an"

or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1A:
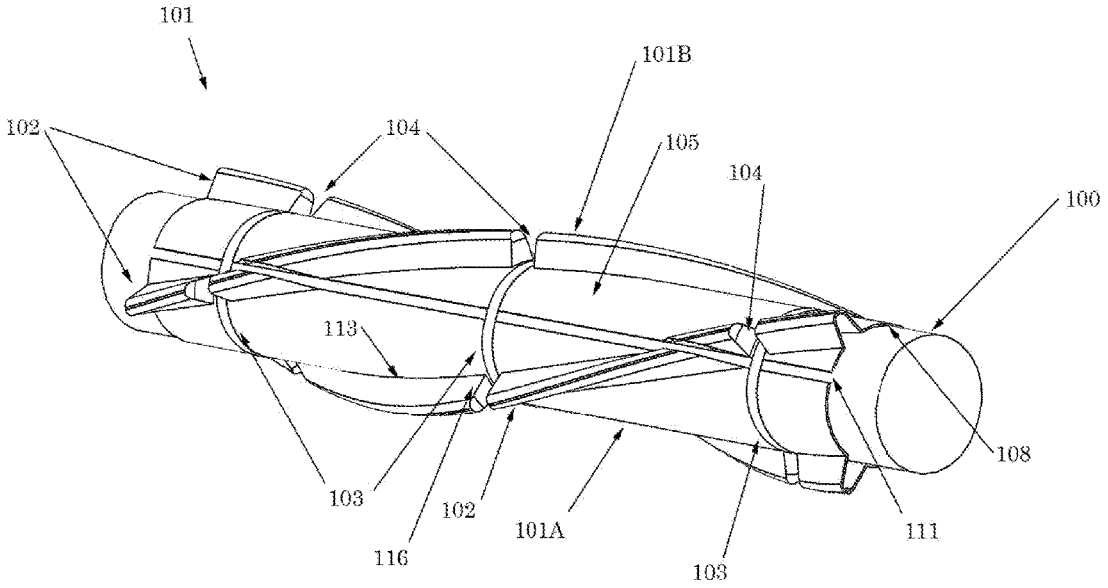
FIG. 1A illustrates a perspective view of one embodiment of a helical strake, consisting of two halves, that is banded to the surface of a cylinder.

Referring now to the invention in more detail, FIG. 1A illustrates a perspective view of one embodiment of a VIV suppression device. In particular, FIG. 1A illustrates a helical strake design consisting of helical strake 101 having a body 105 formed by wall 108. Wall 108 is dimensioned to at least partially, or fully, encircle or envelope an underlying tubular 100. As can be seen in more detail in FIG. 1B, wall 108 includes an outer surface 106 and an inner surface 107. The inner surface 107 faces, and in some cases contacts, the exterior surface of tubular 100 when helical strake 101 is positioned around tubular 100 such that tubular 100 is enveloped by an interior area 110 of helical strake 101. Wall 108 is separated into two separate sections by gap 111 such that helical strake 101 includes helical strake half 101A and helical strake half 101B. Helical strake half 101A and helical strake half 101B are banded to tubular 100 using bands 103 which reside in channels 104. Each of helical strake half 101A and helical strake half 101B cover less than an entire circumference of tubular 100, however, in combination almost entirely encircle tubular 100. Fins 102 are shown attached to, or part of, helical strake 101. Fins 102 extend from an outer surface 106 of wall 108 and may therefore also be referred to herein as extension members. In particular, fins 102 may include a base portion 113 which contacts, or otherwise attaches to, wall 108 of helical strake 101 and a protruding portion 116, which extends from base portion 113 and wall 108. Fins 102 may be positioned along a length dimension of wall 108 such that they are helically arranged around helical strake 101.

Again referring to FIG. 1A, while this figure shows helical strake 101 consisting of two halves, the helical strake is not restricted to consisting of two halves and can be of a single piece or of more than two pieces. In FIG. 1A, bands 103 travel through channels 104 and are put in tension which, in turn, presses helical strake half 101A and helical strake half 101B against tubular 100. This allows helical strake 101 to be constrained from axial motion relative to tubular 100.

Still referring to FIG. 1A, any number of bands may be used in the helical strake and the fins 102 may be of any size or shape. While FIG. 1A shows channels 104 between adjacent fins 102, fins 102 may be continuous and not have channels 104 present. Fins 102 may also utilize slots that allow bands 103 to travel through fins 102 and thereby, when bands 103 are put into tension, press helical strake 101 against tubular 100. Fins 102 may be formed separately from helical strake half 101A and helical strake half 101B and then attached by any suitable mechanism (this also applies to the copper aspects disclosed herein).

Still referring to FIG. 1A, all parts shown may be made of any suitable material including, but not limited to, plastic, metal, rubber or elastomer, ceramic, wood, composite, and synthetics.

Figure 1B:
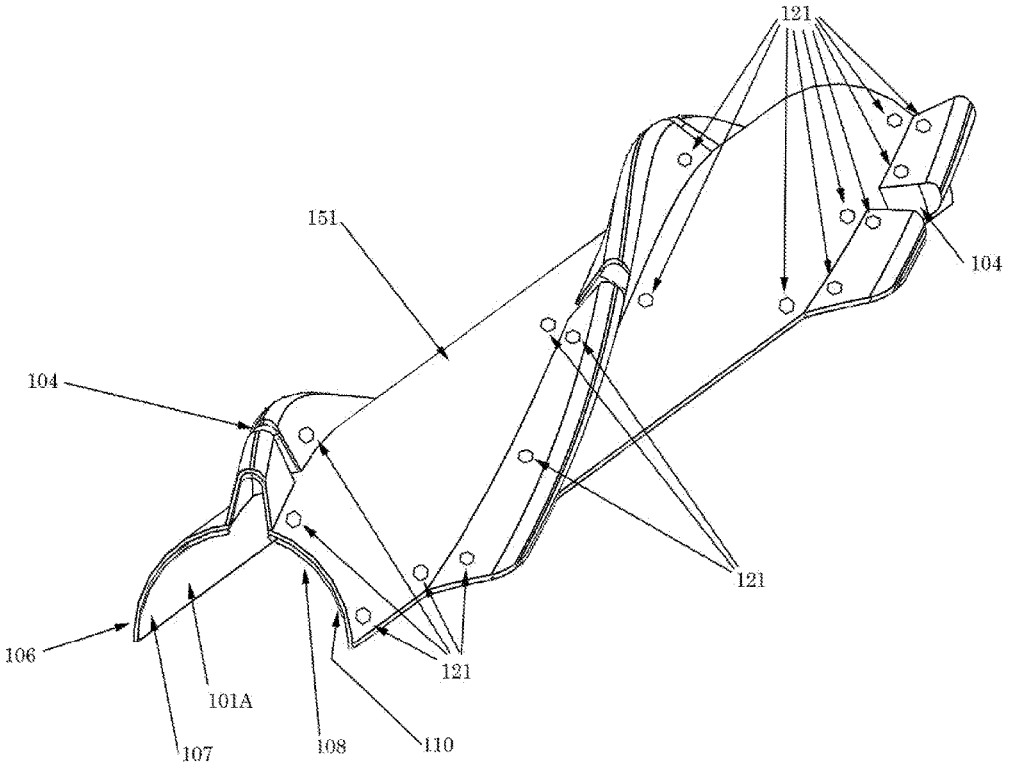
FIG. 1B illustrates a perspective view of one embodiment of a helical strake half with an anti-fouling member over the external surface.

Referring now to FIG. 1B, helical strake half 101A, which also has channels 104 present, is shown covered with anti-fouling member or sheet 151. In one embodiment, anti-fouling sheet 151 is attached to helical strake half 101A using fasteners 121. Anti-fouling sheet 151 may be mechanically attached to an outer surface 106 of helical strake half 101A. The outer surface 106 may be a surface which faces away from tubular 100, when helical strake half 101A is positioned around the tubular 100 as shown in FIG. 1A. Fasteners 121 may be any type of fastener suitable for attaching two structures together, for example, fasteners 121 may be screws or pins which are inserted through openings in anti-fouling sheet 151 and corresponding openings within helical strake half 101A.

Again referring to FIG. 1B, anti-fouling sheet 151 is shown as a single sheet but can consist of multiple pieces to cover helical strake half 101A (anti-fouling sheet may be used to cover helical strake half 101B shown in FIG. 1A, and can be used to cover any or all of helical strake 101 shown in FIG. 1A-FIG. 1B. FIG. 1B simply illustrates one embodiment of how anti-fouling sheet 151 may cover a portion of a helical strake. Anti-fouling sheet 151 may cover all or part of a helical strake half or section (for example, different sections of anti-fouling sheet 151 may be used to cover each of the fins and other sections may be used to cover the base portion of the strake). Different pieces of anti-fouling sheet 151 may overlap (or underlap) and may, or may not, cover the ends or underside of helical strake half 101A. Representatively, in one embodiment, anti-fouling sheet 151 may be a short piece of copper that covers ⅓ of the circumference of helical strake 101 and several of these pieces are assembled axially along helical strake 101 to cover helical strake 101. In addition, anti-fouling sheet 151 may, in some embodiments, be preformed to the strake shape prior to installing on the helical strake 101.

While FIG. 1B shows anti-fouling sheet 151 attached to helical strake half 101A using fasteners 121, other attachment means may be used in addition to, or in place of the use of fasteners 121. Any suitable attachment means may be used, including bands (such as bands 103 in FIG. 1A), adhesives, any fastening methods such as screws, bolts, nuts, rivets, or clamps, or other structural members (which may also be used to assist with adhesive attachment means). Any combination of methods may also be utilized. The anti-fouling material (e.g. copper) may also be plated to helical strake half 101A or attached by other thermal means to form a anti-fouling sheet. It should be understood, however, that the anti-fouling sheet 151 as disclosed herein is different from other anti-fouling methods in which a liquid including an anti-fouling material (e.g. copper particles) is applied to a VIV device, such as by painting, to form a coating over the VIV device surface. In other words, the anti-fouling sheet 151 is different form a coating in that it is a solid sheet of material that is mechanically attached to the helical strake and can maintain the desired shape without the presence of the helical strake it is attached to. Other existing methods of applying anti-fouling particles such as painting or coating, however, may be used in conjunction with the subject invention. Anti-fouling sheet 151 may be fairly soft and manually formed to the shape of the helical strake or may be relatively hard and formed to the helical strake by a heating method such as vacuum forming or drape molding. Parts of anti-fouling sheet 151 may be relatively soft and manually formed to the helical strake and other parts of anti-fouling sheet 151 may be hard and heated to the desired shape. For example, anti-fouling for the fins may be formed separately.

Still referring to FIG. 1B, anti-fouling sheet 151 may be of any suitable thickness and does not have to be of constant thickness and various sections or pieces of anti-fouling sheet 151 may be of different sizes or thicknesses. Anti-fouling sheet 151 will typically be of a thickness ranging from 3 mils to 125 mils. Fasteners 121 may be of any size, shape, type or quantity, and any of the various attachment methods may be used to permanently attach anti-fouling sheet 151 to helical strake half 101A or may be used temporarily, for example to hold anti-fouling sheet 151 in place until bands may be attached. Anti-fouling sheet 151 may have holes or openings. For example, if the fins are continuous then slots may be cut in both the fins and in anti-fouling sheet 151 so that bands may travel through the slots for installation. Multiple holes or openings may also be present in anti-fouling sheet 151 so that it resembles netting or meshing (with no limit on the porosity of anti-fouling sheet 151).

Still referring to FIG. 1B, while anti-fouling sheet 151 is presumably made of anti-fouling, the anti-fouling does not need to be pure copper and can consist of various copper alloys such as copper-nickel alloys, copper-zinc alloys (brass), and copper-tin alloys (bronze). Fasteners 121 may be made of any suitable material including, but not limited to, metal, plastic, composite, and synthetics.

Figure 1C:
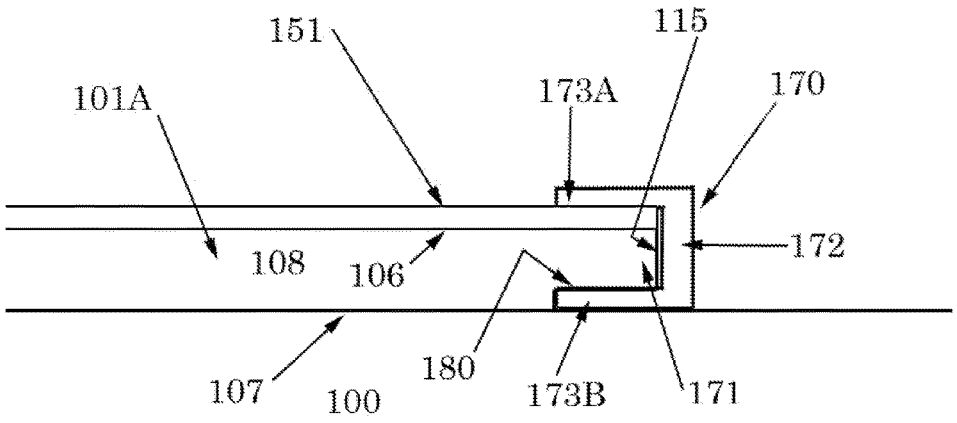
FIG. 1C illustrates a side view of the edge of the helical strake half of FIG. 1B with one embodiment of a clamp along the edge to secure an anti-fouling member to the helical strake.

Referring now to FIG. 1C, this figure illustrates a possible modification to one or more edges of a VIV suppression device to facilitate attachment of an anti-fouling sheet to the VIV suppression device. Representatively, in this embodiment, anti-fouling sheet 151 may be held in place along an edge of a helical strake half 101A, such as that previously described, by a receiving member 170 formed along the edge of the helical strake half 101A. The receiving member 170 may be, for example, a "C" shaped clamp, which forms a channel 171 along the edge 115 of helical strake half 101A. In particular, receiving member 170 may include an end portion 172 from which two side arms 173A, 173B extend. The channel 171 may be formed by the inner (interfacing) surfaces of end portion 172 and two side arms 173A, 173B. Side arms 173A, 173B may be spaced a sufficient distance from one another such that channel 171 is wide enough to receive both the end of strake half 101A and sheet 151 and hold the two pieces together. Representatively, in one embodiment, end portion 172 is positioned along the edge 115 of strake half 101A such that side arm 173A is positioned along the outer surface 106 of the wall 108 of strake half 101A and side arm 173B is positioned along the inner surface 107 of the wall 108 of strake half 101A. In other words, side arm 173B is between strake half 101A and tubular 100, for example, adjacent to tubular 100. To accommodate the positioning of side arm 173B between strake half 101A and tubular 100, a recessed region 180 for receiving side arm 173B may be formed along the inner surface 107 of the wall 108 of strake half 101A.

Again referring to FIG. 1C, any number or length of edges of helical strake half 101A may have receiving member 170 in place. Receiving member 170 may be attached to helical strake half 101A, to anti-fouling sheet 151, or to tubular 100. Receiving member 170 may also be held in place by pressure on helical strake half 101A and anti-fouling sheet 151 against tubular 100. This pressure may come from an adjacent location such as from an adjacent band. The pressure may also simply come from an interference fit of the channel 171 of receiving member 170 onto helical strake half 101A and anti-fouling sheet 151.

Still referring to FIG. 1C, receiving member 170 may be of any suitable size or shape and may be attached to helical strake half 101A, to anti-fouling sheet 151, or to tubular 100 by any suitable means including, but not limited to, banding, clamping, fastening, and chemical bonding.

Still referring to FIG. 1C, receiving member 170 may be made of any suitable material including, but not limited to plastic, metal, elastomer, or composite.

Figure 1D:
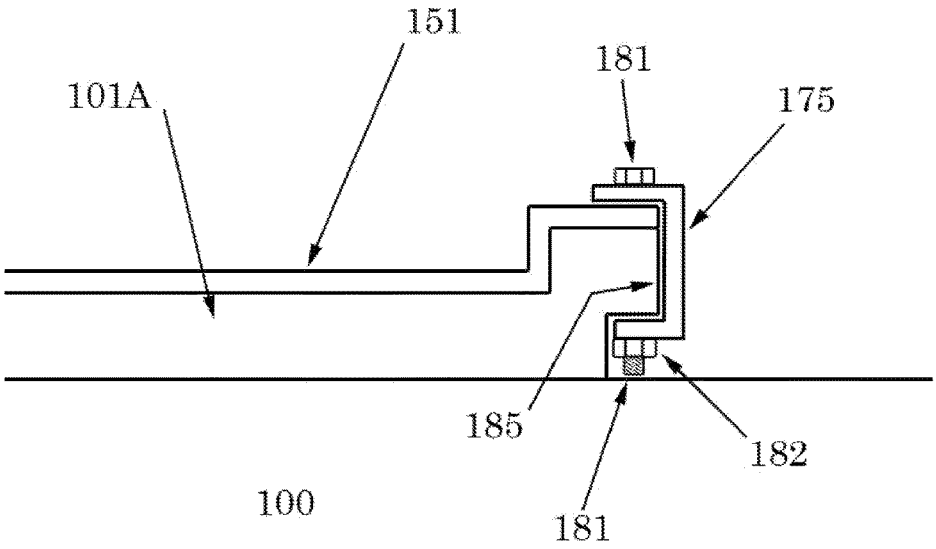
FIG. 1D illustrates a side view of the edge of the helical strake half of FIG. 1B with another embodiment of a clamp along the edge to secure an anti-fouling member to the helical strake.

Referring now to FIG. 1D, this figure illustrates another possible modification to one or more edges of the subject invention. Helical strake half 101A and anti-fouling sheet 151 are held in place at the edge by receiving member 175, which includes channel 185 and is adjacent to tubular 100. Receiving member 175 is shown optionally attached to helical strake half 101A and anti-fouling sheet 151 by screw 181 and nut 182.

Again referring to FIG. 1D, helical strake half 101A and anti-fouling sheet 151 have an adjusted shape to accommodate receiving member 175, screw 181, and nut 182. While screw 181 and nut 182 are optional, any suitable means may be used for attaching or connecting receiving member 175 to helical strake half 101A or anti-fouling sheet 151. Receiving member 175 may, or may not, contact tubular 100.

Still referring to FIG. 1D, Receiving member 175 may be made of any suitable size, shape, or quantity. While a C-shape cross section is shown for channel 185, any suitable shape may be used for channel 185 which may be replaced by other structural shapes and merely illustrates that a structural member may be used to assist with connecting anti-fouling sheet 151 and helical strake half 101A (this also applies to receiving member 170 in FIG. 1C).

Still referring to FIG. 1D, receiving member 170 may be made of any suitable material including, but not limited to plastic, metal, elastomer, or composite.

Figure 2A:
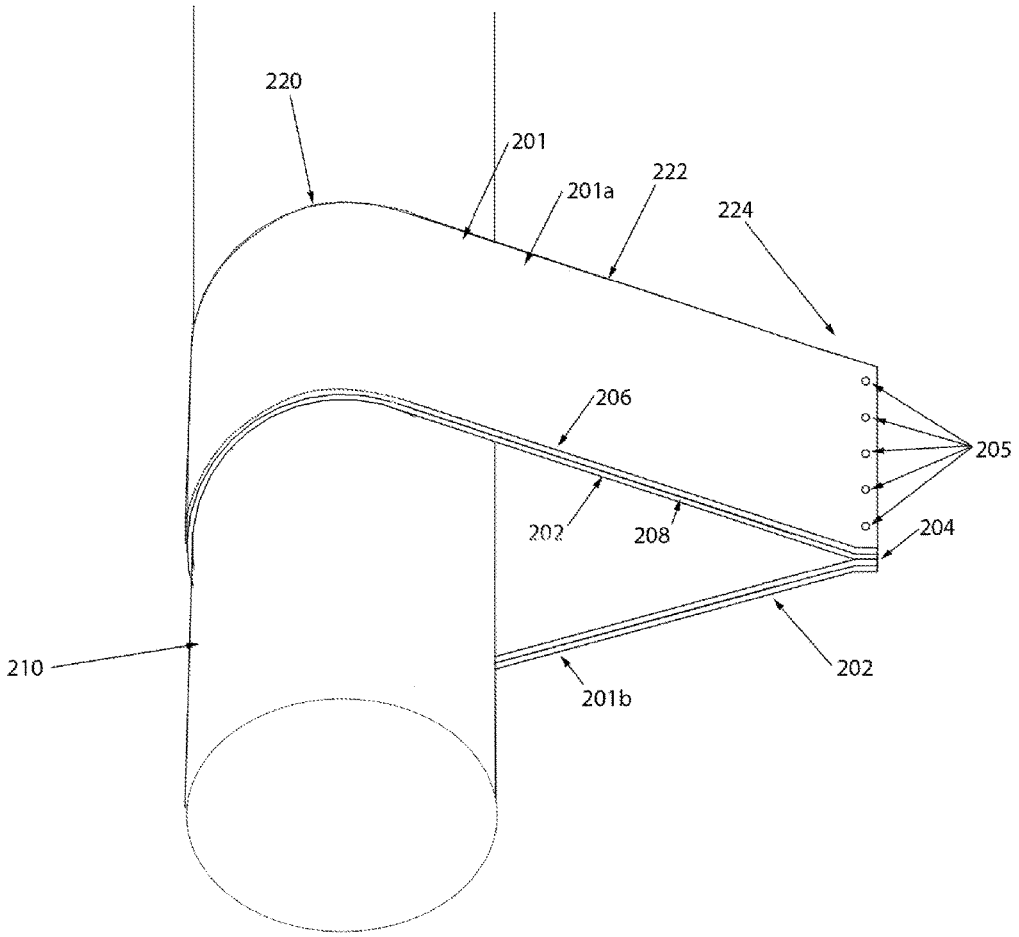
FIG. 2A illustrates a perspective view of another embodiment of a VIV suppression device having an anti-fouling member attached thereto.

FIG. 2A illustrates a perspective view of another embodiment of a VIV suppression device having an anti-fouling member attached thereto. In this embodiment, the VIV suppression device is a fairing 201, which is dimensioned to suppress VIV of an underlying structure or tubular 210. Fairing 201 may include a wall 202 that forms a body portion 220 which encircles an underlying structure or tubular 210 and a tail portion 222 that extends from body portion 220 and tapers to form an end portion 224. The tail portion 222 may also be referred to herein as an extension member. Fairing 201 may be include first section 201A and second section 201B that can be separated along opening 204 so that fairing 201 can be positioned around underlying structure or tubular 210. Once fairing 201 is positioned around tubular 210, it is free to weathervane with changes of angle of the incoming current. In some embodiments, fairing 201, including first section 201A and second section 201B are integrally formed pieces that are formed together as a single unit. In other embodiments, first section 201A and second section 201B of fairing 201 are separate modules, that are formed independently of one another. Fairing 201 can be made of plastic, rubber, wood, fiberglass or other composite materials, metals, or any suitable material that allows it to maintain its approximate shape.

Fairing 201 may further include an anti-fouling member 206 attached to the wall 202. The anti-fouling member 206 may be similar to the anti-fouling member previously discussed in reference to FIG. 1A-FIG. 1D, except in this case it is dimensioned to cover a fairing 201. Representatively, anti-fouling member 206 may be a sheet of anti-fouling material that is wrapped around an outer surface 208 of wall 202 of fairing 201. Anti-fouling member 206 may be attached to wall 202 mechanically using fasteners 205. Fasteners 205 may be similar to the fasteners 121 previously discussed in reference to FIG. 1A-FIG. 1D.

Figure 2B:
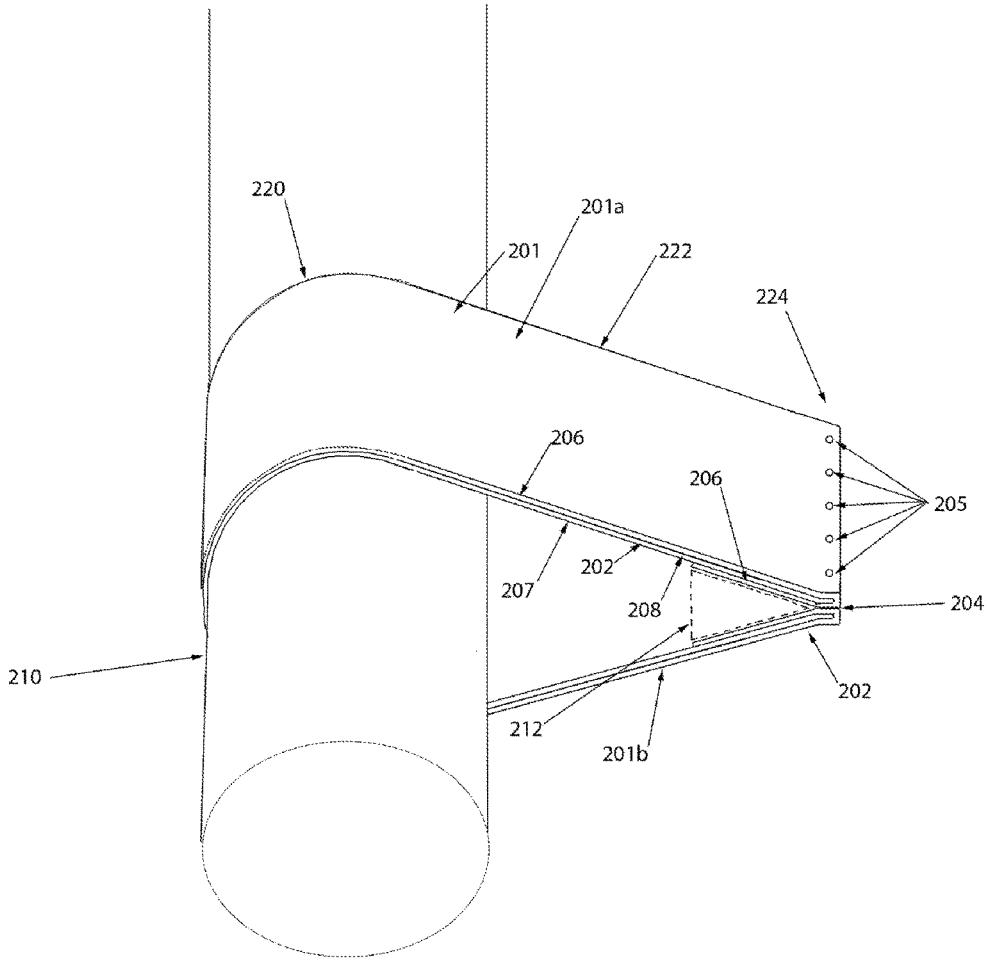
FIG. 2B illustrates a perspective view of another embodiment of the VIV suppression device of FIG. 2A having an anti-fouling member attached thereto.

FIG. 2B illustrates a perspective view of another embodiment of the VIV suppression device of FIG. 2A having an anti-fouling member attached thereto. In this embodiment, however, the anti-fouling member 206 is shown also positioned over the inner surface 207 of wall 202 of fairing 201. Representatively, anti-fouling member 206 may be wrapped around the outer surface 208 of wall as previously discussed, and then over the end portion 224 such that it extends over the inner surface 207 of fairing wall 202. Positioning of the anti-fouling member 206 between the fairing wall 202 and tubular 210 helps to impede marine growth between fairing 201 and tubular 210. In addition, in some embodiments, anti-fouling member 206 may be optionally held in place along fairing wall 202 by an interior support block 212 (shown in dashed lines) positioned within fairing 201. A tape, or other similar material, may further be positioned around the edges of fairing 201 and anti-fouling member 206 to reduce the sharpness of the edges.

Figure 3:
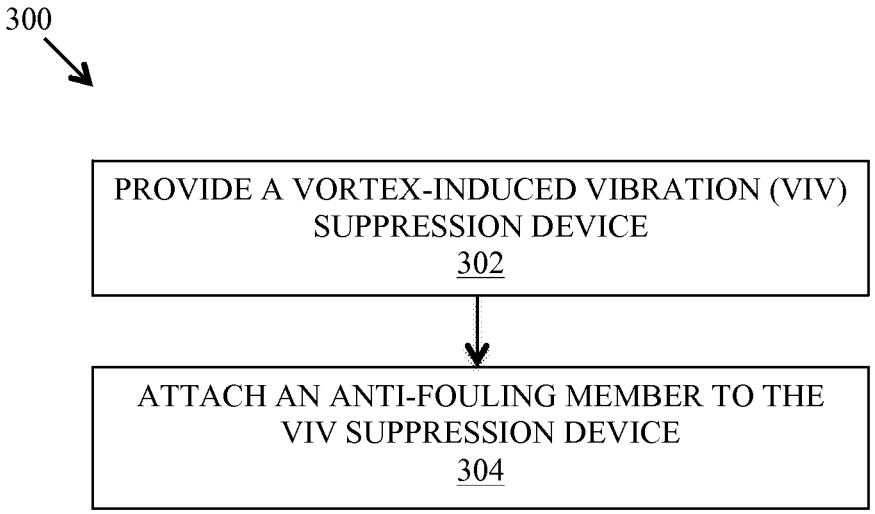
FIG. 3 illustrates one embodiment of a process for manufacturing a VIV suppression device having an anti-fouling member.

FIG. 3 illustrates one embodiment of a process for manufacturing a VIV suppression device having an anti-fouling member. In one embodiment, process 300 includes providing a VIV suppression device (block 302). The VIV suppression device may, for example, be helical strake 101, and include a body having a wall dimensioned to at least partly envelope a tubular member in an interior area of the body and at least one fin protruding outward from an exterior surface of the wall. Process 300 may further include attaching an anti-fouling member to the VIV suppression device (block 304). For example, the anti-fouling member may be attached to the VIV suppression device by, for example, fastening the anti-fouling member to the exterior surface of the wall of the body. In other embodiments, the anti-fouling member may be attached to the VIV suppression device by positioning a band around the anti-fouling member and the body of the VIV suppression device. Still further, the anti-fouling member may be positioned within a channel formed along an edge of the wall of the body, such as by receiving member 170 or receiving member 175 previously discussed in reference to FIG. 1C and FIG. 1D. Alternatively, a thermal or chemical bonding process may be used to attach the anti-fouling member to the exterior surface of the wall of the body. In some embodiments, the anti-fouling sheet is preformed to have a shape of the VIV suppression device prior to attaching the anti-fouling sheet to the VIV suppression device.

The above aspects of this invention may be mixed and matched in any manner suitable to achieve the purposes of this invention. It is recognized that, while a helical strake has been used to illustrate the invention herein, the concepts presented may be applied to any VIV suppression device such as for a fairing.

In broad embodiment, the present invention consists of methods for attaching pieces of anti-fouling sheet to a VIV suppression device.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

What is claimed is:

1. A vortex-induced vibration (VIV) suppression apparatus comprising:

a body dimensioned to at least partly envelope a tubular member in an interior area of the body;

at least one extension member extending from the body; and an anti-fouling member mechanically coupled to the body and the extension member, the anti-fouling member having a body portion in a shape of the body and an extension portion in a shape of the at least one extension member, and wherein the body portion and the extension portion comprise at least two separate sheets of an anti-fouling material having a surface which is positioned on, and in contact with, a surface of the body and a surface of the extension member, respectively, and at least one of the two separate sheets forming the body portion or the extension portion maintains the shape of the body or the extension member in the absence of the body or the extension member.

2. The VIV suppression apparatus of claim 1, wherein the anti-fouling member contacts an outer surface or an inner surface of a wall forming the body.

3. The VIV suppression apparatus of claim 1, wherein the extension member is a fin protruding outward from an exterior surface of a wall forming the body and the anti-fouling member is positioned over an outer surface of the fin.

4. The VIV suppression apparatus of claim 1, wherein the anti-fouling material comprises copper.

5. The VIV suppression apparatus of claim 1, wherein at least one of the at least two separate sheets of anti-fouling material is attached to the at least one of the body or the extension member by a fastener.

6. The VIV suppression apparatus of claim 1, wherein the sheet of anti-fouling material forming the body portion is attached to the body by inserting the sheet within a channel along an edge of the body.

7. The VIV suppression apparatus of claim 1, wherein the body comprises at least two sections that fit together to form the body.

8. The VIV suppression apparatus of claim 1, wherein the extension member is a fin comprising a slot dimensioned to receive a band for securing the body to a tubular member.

9. A helical strake assembly comprising:

a helical strake having a body section and a fin helically arranged around the body; and an anti-fouling sheet coupled to the helical strake, the anti-fouling sheet having a body portion having a surface that conforms to, and contacts, a surface of the body section of the helical strake and a fin portion having a surface that conforms to, and contacts, a surface of the fin of the helical strake, and wherein the body portion and the fin portion of the sheet are preformed into a shape of the body section and the fin prior to being coupled to the helical strake.

10. The helical strake assembly of claim 9, wherein the anti-fouling sheet is mechanically coupled to an exterior surface of the helical strake.

11. The helical strake assembly of claim 9, wherein the anti-fouling sheet is coupled directly to the surface of the body section and the surface of the fin.

12. The helical strake assembly of claim 9, wherein the anti-fouling sheet comprises an anti-fouling material selected from the group consisting of copper, a copper-nickel alloy, a copper-zinc alloy and a copper-tin alloy.

13. The helical strake assembly of claim 9, wherein the anti-fouling sheet is dimensioned to conform to an exterior surface of the helical strake.

14. The helical strake assembly of claim 9, wherein the anti-fouling sheet is coupled to the helical strake by a fastener positioned through the sheet and the body section.

15. The helical strake assembly of claim 9, wherein the anti-fouling sheet is coupled to the helical strake by a band dimensioned to encircle the body section.

16. The helical strake assembly of claim 9 wherein the anti-fouling sheet is coupled to the helical strake by a "C" shaped clamp positioned along an edge of the body section.

17. A method of manufacturing a vortex-induced vibration (VIV) suppression device comprising:

providing a VIV suppression device having a body dimensioned to at least partly envelope a tubular member in an interior area of the body and at least one extension member extending from the body;

forming an anti-fouling sheet dimensioned to conform to a shape of the VIV suppression device, wherein forming comprises forming a body section dimensioned to conform to a surface of the body of the VIV suppression device and separately forming an extension member section dimensioned to conform to a surface of the extension member of the VIV suppression device; and separately attaching the body section of the anti-fouling sheet to a surface of the body of the VIV suppression device and attaching the extension member section of the anti-fouling sheet to a surface of the extension member of the VIV suppression device.

18. The method of claim 17, wherein attaching the body section of the anti-fouling sheet comprises mechanically fastening the anti-fouling sheet to an outer surface of a wall of the body.

19. The method of claim 17, wherein the anti-fouling sheet is preformed to have a shape of the VIV suppression device prior to attaching the anti-fouling sheet to the VIV suppression device.

* * * * *